United States Patent [19]

Yates

[11] 4,298,073

[45] Nov. 3, 1981

[54] DRILL HEAD

[75] Inventor: George A. Yates, Grove City, Ohio

[73] Assignee: Eagle-Picher Industries, Inc., Cincinnati, Ohio

[21] Appl. No.: 35,732

[22] Filed: May 3, 1979

[51] Int. Cl.[3] ..... E21B 7/02; E21C 7/02

[52] U.S. Cl. ..... 173/22; 173/57; 277/165

[58] Field of Search ..... 173/22, 57, 63, 64, 173/73; 277/165

[56] References Cited

U.S. PATENT DOCUMENTS

| | | | |
|---|---|---|---|
| 2,456,819 | 12/1948 | Dobbs | 173/22 X |
| 2,766,012 | 10/1956 | Hale | 173/22 X |
| 2,771,273 | 11/1956 | Pond | 173/22 X |
| 2,866,670 | 12/1958 | Harris et al. | 277/165 X |
| 2,960,311 | 11/1960 | Scott | 173/57 X |
| 3,032,129 | 5/1962 | Fletcher et al. | 175/320 |
| 3,403,916 | 10/1968 | Durham et al. | 277/165 X |
| 4,141,562 | 2/1979 | Wu | 277/165 X |
| 4,190,116 | 2/1980 | O'Neal | 173/57 X |

FOREIGN PATENT DOCUMENTS

| | | | |
|---|---|---|---|
| 47-15083 | 5/1972 | Japan | 277/165 |

OTHER PUBLICATIONS

Drawing of Lee Norse.

Drawing of "Heavy-Duty Drill Pot Assembly", Galis Electric & Machine Co., 9/30/60.

Drawing of "Drill Head Assy.", Superior Hydraulics, Ind., 6/16/72 and Sep. 1976.

*Primary Examiner*—Wm. Carter Reynolds

*Attorney, Agent, or Firm*—Wood, Herron & Evans

[57] ABSTRACT

A drill head having a housing enclosed at its lower end by a lower cover and enclosed at its upper end by a drive cap which carries a drill tool chuck. Radial-thrust bearings are located in the upper portion of the housing. A driven bevel gear is located below the radial-thrust bearings. A hollow passageway through the drill tool, chuck, bearings and driven gear is sealed by a face seal located below the driven gear and mounted in part on the lower cover so as to be easily replaced by removal of the lower cover. A driving bevel gear, on a horizontal axis, is mounted on an adapter on the rear end of the housing, the adapter receiving a hydraulic motor connected to the driving gear.

8 Claims, 5 Drawing Figures

13
16
27
26
24
25
22
30
28
44
40
41
20
73
~50~
~34~
102
100
72
36
33
21
92
91
31
~35~
32
71
53
51
96
65
66
97
70
55
67
54
95
61
60
64
98
62
90
76
94
78
77
85
86
23
115
105
102
101
75
15
80
VACUUM SOURCE & DUST COLLECTOR
87

DRILL HEAD

This invention relates to a drill head for drilling holes in mine roof strata.

In mining operations, the mine roof is supported by drilling vertical holes in the roof and securing elongated rods in those holes by means of expanders or epoxy. A series of such rods, located across an expanse of mine roof, combine with the coal strata to form what is effectively a support beam in the mine roof.

The present invention is directed to the drill head by which the holes are bored in the mine roof. The drill head is carried on the end of a pivotable boom which is in turn mounted on a vehicle which is referred to as a roof drill. The vehicle has a motor which adapts it to be driven into the mine to the site at which the roof is to be drilled. The roof drill vehicle carries means for supplying hydraulic fluid under pressure to a hydraulic motor attached to the drill head, and it carries means for applying vacuum to the drill head to suck away dust as it is abraded away from the roof during the drilling of a vertical hole.

The drill head carries a drilling tool which is hollow, the drilling tool communicating with a passageway in the drill head which is in turn connected to a vacuum system for sucking the dust away from the drilled hole as it is being formed.

The boom, swinging the drill head upwardly during the drilling operation, applies thousands of pounds of thrust to the drill head. The combination of the high thrust load on the drill head and rotary parts; the exposure to an extremely dusty environment; the fact that a vacuum is applied to the interior of the drill head to draw the dust through a drill head and into a dust collector all contribute to the need that the drill head be designed to accept substantial loads; to keep dust away from the working parts; and to keep the lubricant applied without leakage to the moving parts.

The drill head is powered from a hydraulic motor connected to the rear of the drill head with the power from the hydraulic motor being transmitted from a horizontal axis through a right angle transmission to a vertical chuck and drill on the drilling head. To accommodate this drive system, the drill head includes a gear box enclosed in a casing having on its rear end an adapter for receiving the hydraulic motor. The adapter is connected to a beveled pinion gear on a horizontal axis which meshes with a main bevel gear on a vertical axis. The main bevel gear is connected to the chuck which carries the tool and is hollow so that the dust may pass through it. A cavity surrounds the gears and is filled with oil to provide a lubricant for all of the bearings in the system.

An objective of the present invention has been to provide a radial thrust bearing set by which the rotating tool and the like are mounted to the casing and locating the bearings in the upper portion of the drill head where they are out of the way of the face seal which provides the rotary seal between the fixed casing and the rotating parts. In accordance with the invention, the bearings are oriented in such a manner that they are lubricated from the oil in the casing through the action of the rotating parts splashing the oil upon the bearings.

One of the critical areas of concern involves the exhaust passageway and the rotary seal which is required between the stationary casing and the rotating elements. Therefore, another objective of the invention has been to locate a seal between the fixed casing and the rotating parts in an accessible position below the main bevel gear and supported in such a way that it can be easily removed and replaced.

Another objective of the invention has been to provide an improved connection and the mounting of the hydraulic drive motor to the beveled driving gear so that the driving hydraulic motor shaft will not be subjected to the gear load. More specifically, within the housing the pinion gear is supported by radial bearings and has a splined female coupling adapted to receive the shaft from the hydraulic motor. An adapter is provided for mounting the hydraulic motor in such a way that there is no force moment applied to the hydraulic motor shaft from the bevel gear through the spline connection.

Still further, the motor mounting adapter is provided with a small vent which prevents leaking hydraulic oil under high pressure in the hydraulic motor from blowing into the gear box and blowing out the lubricating oil.

The whole motor/mount structure admits of the use of a variety of hydraulic drive motors with the same drill head, different motors being adapted to be mounted on the drill head by changing the adapter on the drill head.

The several objectives and features of the invention will become more readily apparent from the following detailed description taken in conjunction with the accompanying drawings in which.

Figure 1:
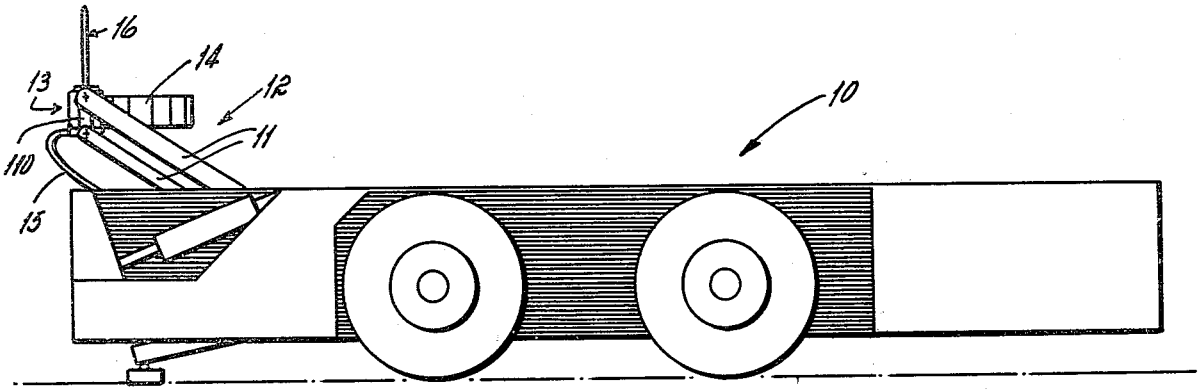
FIG. 1 is a side elevational view of a roof drill vehicle with which the invention is used.

In referring a FIG. 1, a roof drill vehicle 10 is illustrated as having a pivotal boom 12 which carries at its ends a drill head 13. The drill head 13 has a hydraulic motor 14 directly mounted on its rear face. A vacuum hose 15 is mounted on the drill head to suck dust away from the drill head as dust chips and the like are created by the drilling by the tool 16 mounted in the upper end of the drill head.

Figure 4:
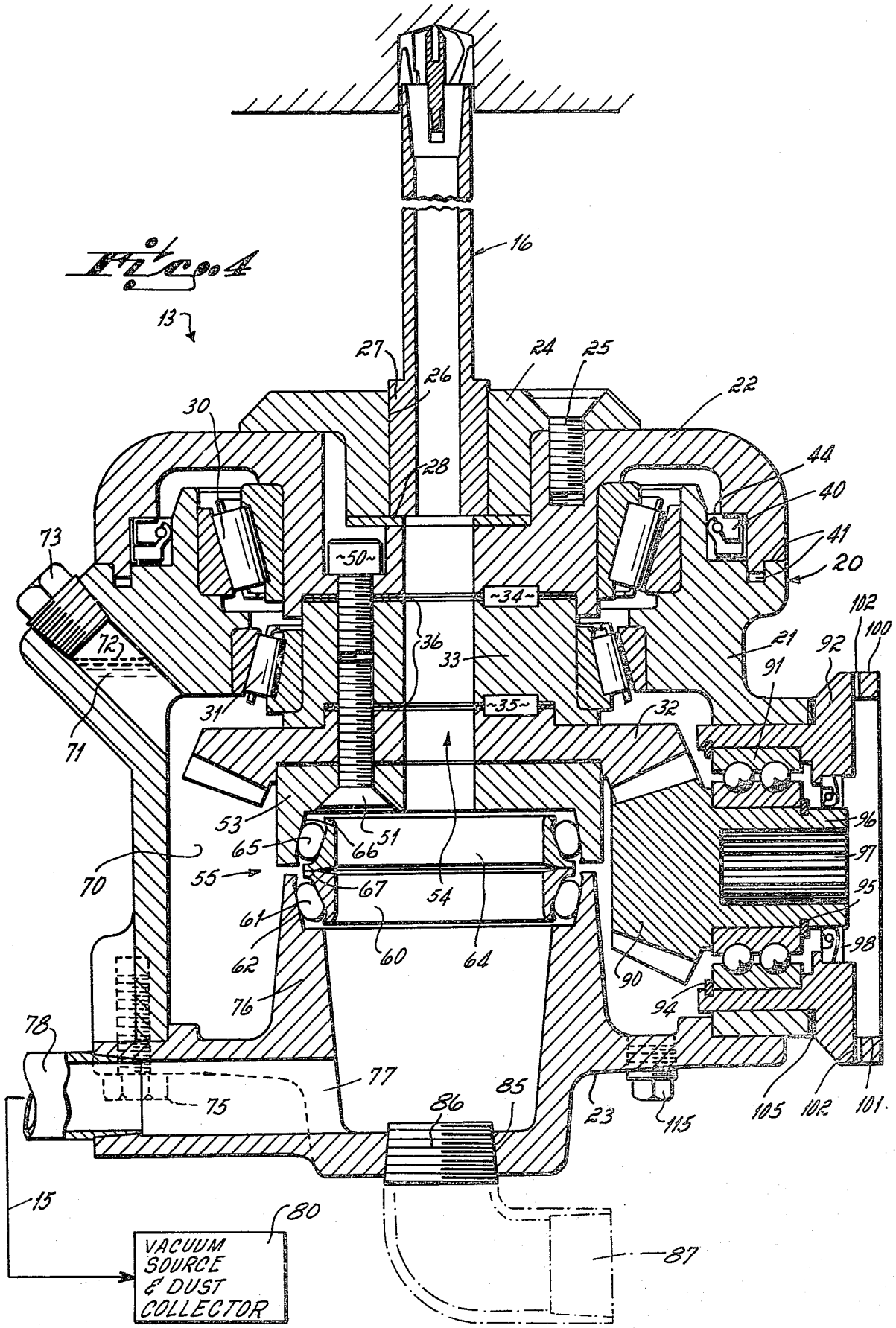
FIG. 4 is a cross-sectional view taken along lines 4—4 of FIG. 2.

The drill head is best illustrated in FIG. 4 and has a housing 20 which includes a body 21 which has no fixed upper cover but which is enclosed at its upper end by a rotatable drive cap 22 and at its lower end by a lower cover 23. The drive cap 22 carries a chuck 24 secured to it by two flat-headed screws 25. The chuck has a hexagonal or square vertical hole 26 adapted to receive the hexagonal or square shank 27 of the hollow tool 16. The hollow tool 16, at its lower end, rests upon a washer 28 clamped between the chuck 24 and the drive cap 22.

The drive cap is supported on the body 21 by a radial thrust bearings set consisting of upper rollers 30 and lower rollers 31. The drive cap is connected to a driven bevel gear 32, rotatable about a vertical axis, by means of an adapter 33. The adapter is drivably connected to the drive cap by an upper dowel pin 34 and to the driven bevel gear 32 by a lower dowel pin 35.

Figure 2:
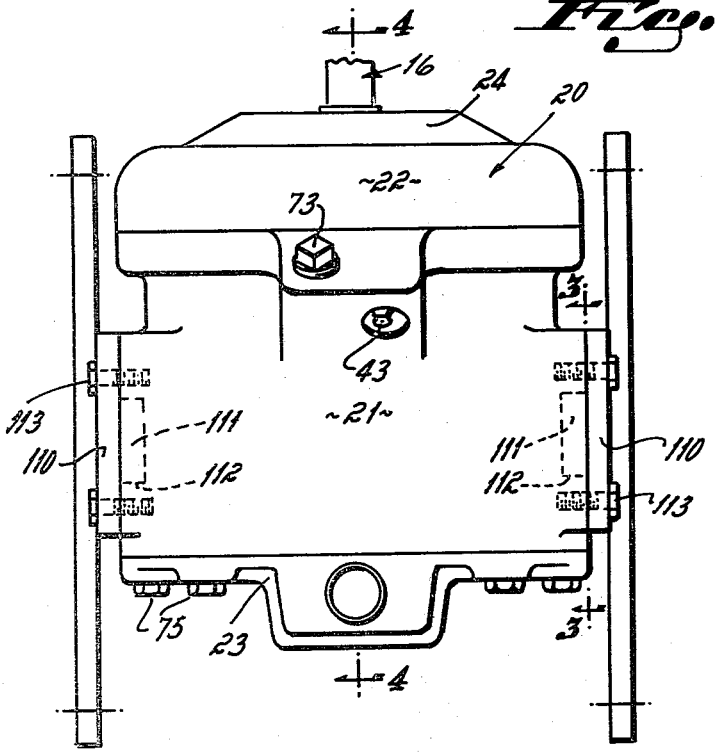
FIG. 2 is a front elevational view of the drill head of the invention.
Figure 3:
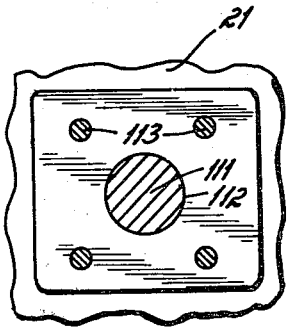
FIG. 3 is a cross-sectional view taken along lines 3—3 of FIG. 2.

A shim set 36 is interposed between the drive cap 22 and the adapter 33 and between the adapter and gear 32 in order to make the final adjustment between the cooperating bearings 31 so that their races are neither too tight nor too loose. A conventional upper seal (Gar Lock 53×3406) is located between the drive cap 22 and the body 21. The seal is disposed in a tortuous path or labyrinth indicated generally at 41 created between the mating surfaces of the drive cap 22 and body 21. A grease gun fitting 43 (FIG. 2) is mounted in the body housing and is adapted to permit grease to be introduced into the tortuous path 41. It is intended that the grease flow approximately to the point indicated by the numeral 44 to lubricate the surface of the body and drive cap, respectively, as well as the upper seal 40. The grease also tends to block the penetration of dust into the interior of the housing during the operation of the drill head.

The drive cap 22 is secured to the adapter 33 by a socket head cap screw 50 which is threaded into the adapter 33. The driven gear 32 is clamped to the adapter 33 by a flat head cap screw 51 which also passes through a seal retainer 53. The drive cap 22, adapter 33, driven gear 32 and seal retainer 53 have aligned axial bores 54 through which dust and grit pass from the hollow drilling tool 16. That dust and grit is sealed against entry into the interior of the housing at the interface between the rotary elements and the stationary casing by a face seal or duplex seal 55 (Catepillar 2M2858). The seal consists of a fixed ring 60 which compresses a flexible ring 61 against a surface 62 of the lower cover 23 and an upper rotary ring 64 which compresses a rotating flexible ring 65 against a surface 66 of the seal retainer 53. The rubbing surfaces 67 between the two rings 60 and 64 are especially treated for long life.

The housing has a cavity 70 which is filled with a lubricant 71 to a level at approximately 72 through an opening normally closed by a vented fill plug 73. The function of the duplex seal 55 is to prevent the lubricant from flowing or being sucked into the passage 54 when vacuum is applied and to prevent dust from penetrating into the cavity 70 during operation of the tool.

The duplex seal is a critical part and has to be changed frequently during the life of the drill head. For example, the seal 55 might have to be replaced ten times during the life of the drill head. To that end, the operating elements are positioned with respect to each other and the housing so as to place the major rotating elements such as the driven gear 32, the bearings 30, 31 and the chuck 24 all in the upper portion of the housing while locating the seal 55 in the lower portion of the housing. Further, the seal is enclosed by the lower cover 23 and can be replaced (after the oil is preliminarily drained) simply by removing six hexagonal head screws 75 which secure the lower cover to the body 21 and removing the lower cover. When the lower cover 23 is removed, a new duplex seal can easily be inserted.

The lower cover 23 has an upstanding circular flange 76 which includes the surface 62 which supports the duplex seal 55. The lower cover and the body are designed to create as large a cavity 70 as possible so that as much lubricating oil as possible can be contained in the drill head.

The lower cover has two exhaust passageways. First, a lateral passageway 77 is adapted to receive a pipe nipple 78 by which the exhaust hose 15 connects the drill head to a vacuum source and dust collector 80. Alternatively, a hole 85 is provided in the lower wall of the lower cover, that hole normally being closed by a plug 86. When possible, the vacuum hose is connected by means of a street elbow 87 to the hole 85, the connection of the vacuum source to the hole 85 being normally preferred since the grit and dust will be driven straight down through the hole with most of the abrasion occurring on the replaceable street elbow as the material exits the drill head.

Figure 5:
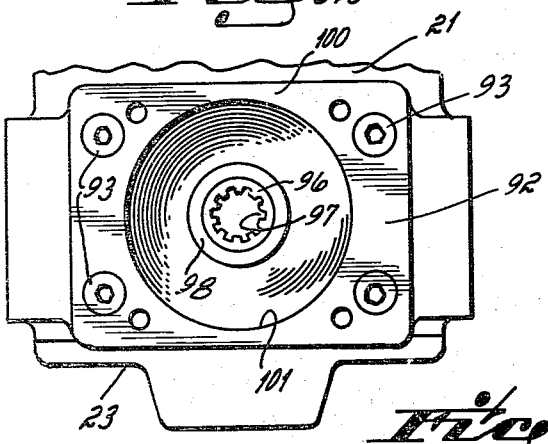
FIG. 5 is a rear elevational view of the drill head.

The gear 32 is driven by a beveled pinion gear or driving gear 90 which is rotatably mounted by radial bearings 91 on an adapter 92 which is bolted to the body or housing 20 by flat head screws 93 (FIG. 5) and thus forms a part of the housing. The bearings are secured in position by a retaining ring 95 secured to the shank 96 of the gear 90. The shank 96 is splined as at 97 to receive the splined shaft of the hydraulic motor 14 (FIG. 1) by which the drill head is driven. A seal 98 is located between the shank 96 and the adapter 92. The adapter 92 has a rearwardly-projecting, circular flange 100 providing a surface 101 which mates with and forms a pilot fit with a corresponding male surface on the hydraulic motor. The flange 100 has upper and lower vents 102 which permit the discharge of hydraulic motor oil in the event of a leak from the hydraulic motor. If there were no vents, such leaking oil could easily blow through the seal 98 and displace all of the lubricating oil in the cavity 70.

A shim set 105 is interposed between the body 21 and the adapter 92 in order to perfect the alignment between the gear teeth of the driving gear 90 and the driven gear 32.

It can be seen that the adapter 92 can be of any configuration necessary to receive a particular hydraulic motor. Thus, the drill head design admits of use with different types of hydraulic motors.

Similarly, the drill head may be used with different types of drill vehicles having different types of mounting means on the free ends of the boom 12. To this end, the invention contemplates the use of lateral adapter plates 110 whose outer faces are configurated to receive and be connected to the arms 11 of the boom 12. The inner face has a cylindrical boss 111 which projects into a recess 112 in the body 21. The mating boss 111 and recess 112 take the bulk of the shear loading on the drill head. The adapter plate is mounted to the body by four bolts 113.

A drain plug 115 is provided in the lower surface of the lower cover to drain the oil during maintenance.

In operation, the drill head cavity 70 is filled with lubricating oil up to the level of 72. A hollow drilling tool 16 is inserted in the chuck 24. A vacuum hose is connected to the passageway 77 and the drilling operation is ready to begin. The drill head is raised to bring the tool into position against the mine roof. With the vacuum applied, the hydraulic motor 14 drives the tool at about 600 rpm through the drive chain of driving gear 90 and driven gear 32. The lubricant substantially covers the bearing 31 and will be splashed up on the bearing 30 to keep it lubricated. The dust and grit will be drawn by the vacuum through the tool 16 and the passageway 54 and out into the dust collector. The oil in the cavity 70 will be prevented from passing into the passageway 54 by the duplex seal 55. Similarly, the dust will not be permitted to go into the cavity 70 because of the seal 55.

When the seal 55 begins to wear, and this can be detected, for example, by noting the presence of oil in the dust, it can be replaced simply by draining the oil, removing the lower cover and replacing the seal which is no more than a one hour task.

I claim:

1. A drill head comprising, a housing including a lower cover enclosing the lower end of said housing and having no fixed upper cover, a rotatable cap covering the upper portion of said housing, a chuck removably mounted in said cap, a set of radial-thrust bearings only in the upper portion of said housing for rotatably mounting said cap with respect to said housing, said bearings including adjacent tapered upper and lower rollers, said radial-thrust bearings providing the only radial and thrust support for said rotatable cap and chuck, a cavity below said radial-thrust bearing set for lubricant, a rotatable driven bevel gear having a vertical axis and located in said cavity below said radial-thrust bearing set and connected to said cap for rotation therewith, a driving bevel gear having a horizontal axis and rotatably mounted in the side of said housing and meshing with said driven bevel gear, a passageway from said chuck through the lower cover of said housing for drawing, by vacuum, the grit from a drill tool in said chuck, and a rotary face seal in the lower cover of said housing below said driven bevel gear for providing a rotary seal between said lower cover and the driven bevel gear, whereby said face seal can be removed and replaced by removing said lower cover and without disturbing the radial-thrust bearing set.

2. A drill head as in claim 1 in which the lubricant in said cavity has a level high enough to cover at least a portion of the lower rollers and adapted to be splashed on said upper rollers.

3. A drill head as in claim 1 further comprising, said rotatable cap and housing having circular mating surfaces forming a labyrinth, a seal in said labyrinth between at least a portion of said mating surfaces of said cap and housing, respectively, and means to apply grease into said labyrinth up to said seal thereby lubricating said seal and mating surfaces and blocking entry of dust into the interior of said drill head.

4. A drill head as in claim 1 in which said lower cover has a central flange projecting upwardly a substantial distance, said face seal being mounted on said flange, said flange creating, with said housing, a deep cavity for a lubricant.

5. A drill head as in claim 1 further comprising, said housing having recesses in opposed sides thereof and bolt holes surrounding said recesses, adapters bolted on the sides of said housing and adapted to receive the boom of a roof drill vehicle, said adapters each having a cylindrical boss received by said respective recesses to take the bulk of the shear loading on the drill head.

6. A drill head as in claim 1 further comprising, a replaceable adapter fixed to said housing and having a cylindrical bore, a bearing mounted in said bore, said driving bevel gear having a shank projecting through said bearing, said adapter having a flange for mounting a hydraulic motor on said drill head in driving engagement with said driving gear, whereby said adapter can be replaced with one of a different configuration to accommodate a different hydraulic motor.

7. A drill head as in claim 6 further comprising vent holes in said flange for venting hydraulic fluid under pressure from said hydraulic motor.

8. A drill head as in claim 6 in which said driving gear shank projects laterally out of the housing, and a seal mounted between the projecting end portion of said shank and said adapter to seal lubricant in said cavity and to block hydraulic fluid from a hydraulic motor from entering said cavity.

* * * * *